US007262742B2

(12) United States Patent
Takakura

(10) Patent No.: US 7,262,742 B2
(45) Date of Patent: Aug. 28, 2007

(54) ANTENNA FRAME, ANTENNA STRUCTURE, AND WATCH TYPE WAVE CLOCK HAVING THE ANTENNA STRUCTURE

(75) Inventor: Akira Takakura, Chiba (JP)

(73) Assignee: Seiko Instruments Inc. (JP)

( * ) Notice: Subject to any disclaimer, the term of this patent is extended or adjusted under 35 U.S.C. 154(b) by 2 days.

(21) Appl. No.: 11/356,628

(22) Filed: Feb. 17, 2006

(65) Prior Publication Data

US 2006/0187139 A1 Aug. 24, 2006

(30) Foreign Application Priority Data

Feb. 22, 2005 (JP) ..... 2005-046096

(51) Int. Cl.
*H01Q 7/08* (2006.01)

(52) U.S. Cl. ..... 343/788; 343/718

(58) Field of Classification Search ..... 343/718, 343/787, 788

See application file for complete search history.

(56) References Cited

U.S. PATENT DOCUMENTS 6,934,222 B2 * 8/2005 Fujimori ..... 368/204
7,023,395 B2 * 4/2006 Ohara et al. ..... 343/788
7,158,449 B2 * 1/2007 Fujimori et al. ..... 368/47
7,170,462 B2 * 1/2007 Ihara et al. ..... 343/788
2004/0105347 A1 * 6/2004 Fujimori et al. ..... 368/293

* cited by examiner

*Primary Examiner*—Tan Ho
(74) *Attorney, Agent, or Firm*—Adams & Wilks

(57) ABSTRACT

An antenna frame that can suppress shock given to an antenna and position the antenna with controlling increase in size to a minimum, an antenna structure, and a wave clock having the antenna structure are provided. An antenna frame of an antenna structure of a wave clock comprises a frame made of a nonconductive material for receiving and fixing an antenna having an elongated and rod-like, magnetic core and a winding wire wound on the center in a longitudinal direction of the magnetic core. The frame has a recess including a recess portion for receiving a winding portion of the antenna and recess portions for receiving two ends of the magnetic core at both sides of the portion, and end mountings to be mounted on a base at the two ends. When the antenna is received in the recess, ends of the magnetic core are positioned with respect to the portions. The end mountings are mounted on the base in a manner of being contacted to a mounting surface at base side surfaces.

5 Claims, 6 Drawing Sheets

ANTENNA FRAME, ANTENNA STRUCTURE, AND WATCH TYPE WAVE CLOCK HAVING THE ANTENNA STRUCTURE

BACKGROUND OF THE INVENTION

1. Field of the Invention

The invention relates to an antenna frame for receiving and fixing an antenna, an antenna structure having the antenna frame, and a watch type wave clock having the antenna structure.

2. Description of the Prior Art

In a wave clock, ferrite is preferable for a material of a magnetic core of a reception antenna for receiving a standard wave in a long-wave mode, which contains time information, in consideration of loss such as eddy current loss and cost. However, ferrite is extremely brittle and easily breakable.

Therefore, in order to prevent external shock to the ferrite, it has been proposed and known that a magnetic core comprising ferrite is attached to an elastic member such as rubber at two ends, and then the elastic member is attached to a frame (JP-A-2003-110341).

However, the technology disclosed in the JP-A-2003-110341 is limitedly applied to a table clock and the like because it is limitedly used for those that can utilize an elastic member having sufficient size to absorb the shock, in addition, limitedly used for those that usually get comparatively small shock.

On the other hand, it is also proposed that a bobbin having a central, small-diameter tube part and a large-diameter tube part extending from outer circumferences of flanges at two ends of the small-diameter tube part to two end sides is fitted in a rod-like ferrite, and then a wire is wound on the small-diameter tube part to form a coil, and spring projections are provided between the large-diameter tube part and ends of the ferrite core to prevent shock to the ferrite core (JP-A-2004-125606).

In the proposed support structure, although shock to the ferrite core can be prevented by the bobbin and the spring projection, loss tends to be caused by the interposition of the bobbin, in addition, size becomes large due to the interposition of the bobbin and the spring projection.

The invention, which was made in the light of the points, aims to provide an antenna frame that can restrain the shock to the antenna and position the antenna while controlling increase in size to a minimum, and an antenna structure having the frame, and a wave clock having the antenna structure.

SUMMARY OF THE INVENTION

The antenna frame of the invention for achieving the object, which comprises a nonconductive material for receiving and fixing an antenna having an elongated and rod-like, magnetic core and a winding wire (antenna wire) wound on the center in a longitudinal direction of the core, has a recess including a receiving recess portion for winding part for receiving a winding portion of the antenna and a receiving recess portions for magnetic-core ends for receiving two ends of the magnetic core at both sides of the receiving recess portion for winding part, and has end mountings to be mounted on a base at the two ends, and is configured such that ends of the magnetic core of the antenna are positioned with respect to the receiving recess portions for magnetic-core ends when the antenna is received in the recess, and configured such that the end mountings are mounted on the base in a manner of being contacted to a mounting surface of the base at base side surfaces, having openings of the recess.

In the antenna frame of the invention, since the antenna frame is "configured such that ends of the magnetic core of the antenna are positioned with respect to the receiving recess portions for magnetic-core ends when the antenna is received in the recess", the antenna can be accurately positioned with respect to the antenna frame by receiving the antenna in the recess of the antenna frame.

Moreover, in the antenna frame of the invention, since the antenna frame "has a recess including a receiving recess portion for winding part for receiving a winding portion of the antenna and a receiving recess portions for magnetic-core ends for receiving two ends of the magnetic core at both sides of the receiving recess portion for winding part, and has end mountings to be mounted on a base at the two ends, and is configured such that the end mountings are mounted on the base in a manner of being contacted to an mounting surface of the base at a base side surface, having openings of the recess", the antenna can be mounted on the base by mounting the frame on the base such as a base plate, therefore possibility of stress concentration on the magnetic core of the antenna can be suppressed to a minimum. That is, since shock to the base plate or the antenna frame is given to the magnetic core of the antenna in a condition that it has been relieved and distributed by the antenna frame comprising the nonconductive material, possibility of breakage of the magnetic core can be suppressed to a minimum. Moreover, when the antenna frame is mounted on the base, the antenna frame can be accurately positioned with respect to the base; therefore the antenna that has been accurately positioned with respect to the antenna frame can be accurately positioned with respect to the base. Therefore, even if there is a metal component in the surroundings, a relative position of the antenna to the metal component can be kept constant without individual difference, therefore the antenna can be incorporated in a condition that individual difference has been controlled to the minimum. Here, the nonconductive material configuring the antenna frame typically comprises resin. However, the nonconductive material may comprise ceramics and the like, if they have low stiffness similar to that of resin.

In the above, when the antenna is received in the recess of the antenna frame, typically, the antenna is set in the recess of the antenna frame such that the ends of the magnetic core are contacted to bottoms of the receiving recess portions for magnetic-core ends of the recess of the antenna frame, and the antenna is adhered and fixed to the receiving recess portion for winding part using an adhesive filled into a gap between the winding portion of the antenna and the receiving recess portion for winding part of the recess of the antenna frame. As the adhesive, a soft adhesive such as silicone base adhesive is typically used.

Here, the ends of the magnetic core typically are surface-contacted to the bottoms of the receiving recess portions for magnetic-core ends. However, if desired, at least one of the bottoms and the ends of the magnetic core may have an inclined surface (inclined line in a cross section) such that they are approximately line-contacted at two places, as long as stress concentration on particular places of the ends of the magnetic core can be prevented even if the antenna frame experiences shock. When they are contacted at two places, the antenna can be positioned bidirectionally at the same time.

In the antenna frame of the invention, since the antenna is positioned by the antenna frame at the two ends of the magnetic core, and fixed between the antenna frame and the base, the antenna can be fixed without excessive stress being exerted thereon, therefore the bobbin and the like need not provided around the magnetic core, and the winding wire can be actually directly wound on the magnetic core, so that a space between the magnetic core and the winding wire can be controlled to a minimum. Therefore, even if the magnetic core is conductive, loss such as eddy current loss can be suppressed to a minimum.

Furthermore, in the antenna frame of the invention, since walls of the recess of the antenna frame encloses the antenna at least partially, possibility of damage of the winding wire due to mistaken contact of repairing tools and the like to the winding wire of the antenna, can be controlled to a minimum, in addition, even if the magnetic core comprises a brittle material such as a sintered body of ferrite powder, possibility of damage of exposed portions of the ends of magnetic core due to mistaken touch of the repairing tools (for example, tweezers and a screw driver) and the like on the exposed portion can be reduced.

In considering the invention as an antenna structure, in order to achieve the object, the antenna structure of the invention has an antenna frame, which comprises a nonconductive material, having an elongated and rod-like, magnetic core and a winding wire wound on the center in a longitudinal direction of the core; wherein the antenna frame has a recess including a receiving recess portion for winding part for receiving a winding portion of the antenna and receiving recesses for magnetic-core ends for receiving two ends of the magnetic core at both sides of the receiving recess portion for winding part, and has end mountings to be mounted to a base at the two ends, and is configured such that the ends of the magnetic core of the antenna are positioned with respect to the receiving recess portions for magnetic-core ends when the antenna is received in the recess, and configured such that the end mountings are mounted on the base in a manner of being contacted to an mounting surface of the base at base side surfaces having openings of the recess.

It will be clear that the antenna structure of the invention has the advantages described with regard to the antenna frame.

In the antenna structure of the invention, typically, the magnetic core is curved arcuately, and the antenna frame has an outer circumferential wall covering an outer circumferential side of the magnetic core.

In this case, even in a condition that a device body such as wave clock body including the antenna structure is removed from a case, or a back cover is removed, possibility of damage of the winding wire due to mistaken contact of repairing tools and the like to the winding wire of the antenna, can be controlled to a minimum, in addition, possibility of damage of exposed portions of the ends of the magnetic core due to mistaken contact of the repairing tools and the like to the exposed portion can be reduced.

In the antenna structure of the invention, the antenna frame typically has a wall at an inner circumferential side of the receiving recess portions for magnetic-core ends, in addition to the outer circumferential side, furthermore has end walls at ends in a longitudinal direction of the recess. Thus, when the antenna is received in the antenna frame, the antenna can be accurately positioned with respect to the antenna frame. Exactly, in order to prevent excessive stress exerted on the magnetic core, a slight gap is formed between the inner or outer circumferential walls of the receiving recess portions for the magnetic-core ends and the ends of the magnetic core of the antenna. When the antenna structure is incorporated in a watch type wave clock about 2 to 3 cm in diameter, the gap typically has a size of about 0.05 to 0.1 mm. However, the size may be larger or smaller than this.

In the antenna structure of the invention, the antenna frame typically has a projection on a wall situated at a side opposite to the base side surface. Typically, a plurality of projections are provided.

In this case, transformation of the antenna frame can be suppressed to a minimum by presence of the projections. Even if the magnetic core comprises the brittle material such as the sintered body of ferrite powder, since shock to the antenna frame can be received by the projections and therefore relieved by the projections, the shock transmitted to the magnetic core can be controlled to a minimum. When the antenna structure is incorporated in a watch type wave clock, the projections are formed with a height in such a level that they are not touched on the back cover even if the back cover is transformed in some degree.

BRIEF DESCRIPTION OF THE SEVERAL VIEWS OF THE DRAWINGS

A preferred form of the present invention is illustrated in the accompanying drawings in which:

FIG. 1 are views showing a clock body of a wave clock having an antenna structure having an antenna frame of a preferred example of the invention, wherein

FIG. 2 are views showing a mounting condition of the antenna structure of the clock body of FIG. 1, wherein

FIG. 4 are views showing the antenna structure of FIG. 3, wherein

FIG. 5 are views showing the antenna structure of FIG. 3 in another direction, wherein FIG. 6 are views showing the antenna structure of FIG. 3 in still another direction, wherein

DETAILED DESCRIPTION OF THE PREFERRED EMBODIMENTS

Next, a preferred embodiment of the invention will be described according to an example shown in accompanying drawings.

Figure 1A:
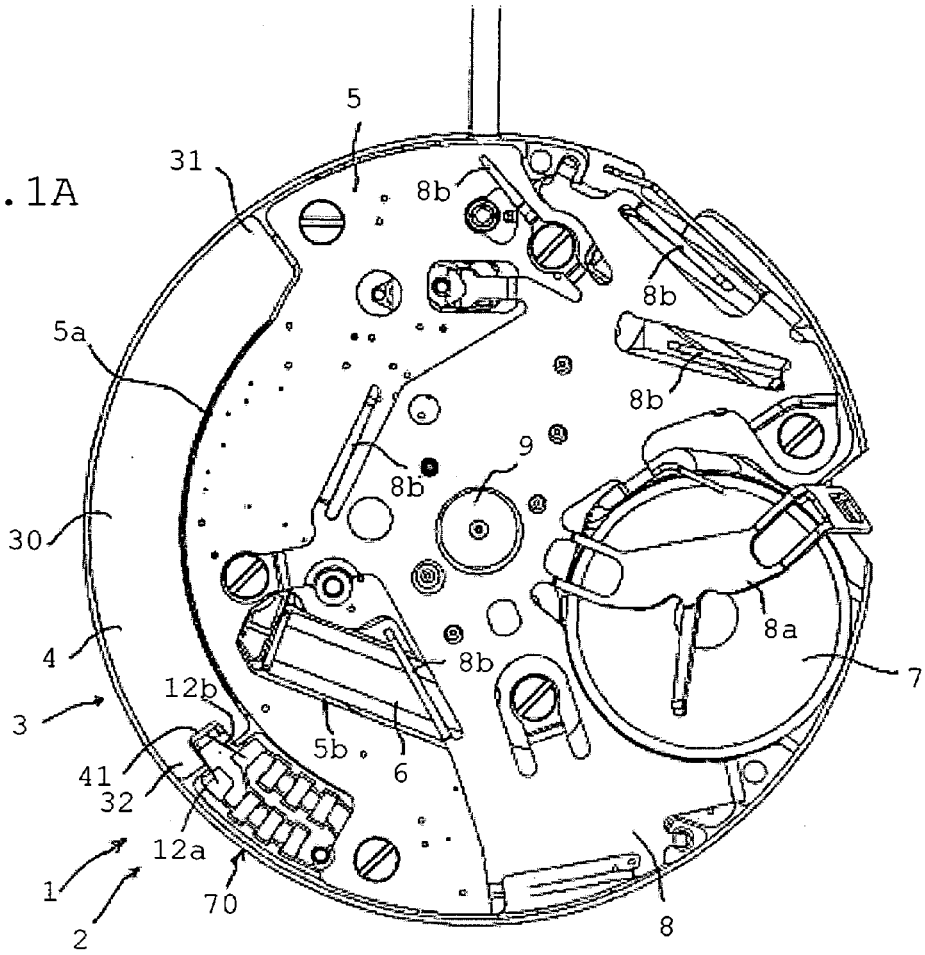
FIG. 1A is a plane, explanatory drawing of the clock body seen from a back cover side.
Figure 1B:
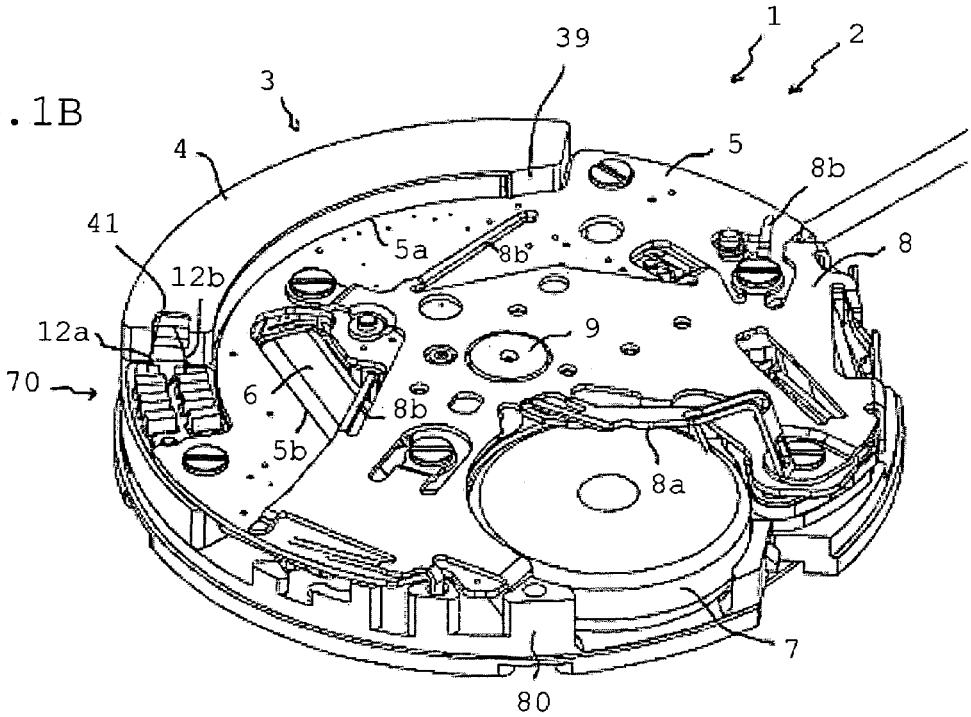
FIG. 1B is a perspective, explanatory drawing of FIG. 1A.

FIG. 1 show a body or clock body 2 configuring a watch type wave clock 1 of a preferred example according to the invention.

The wave clock 1 has an antenna structure 3 extending arcuately near the outer circumference, which is situated close to the inner circumference of a case (not shown). The antenna structure 3 has an antenna body 10, an antenna frame 4 for covering the antenna body 10, and a tuning (resonance) circuit 70.

In regions other than the antenna 3, a circuit board 5 for a clock body configuring a circuit block for the clock body is mainly disposed. In this example, the circuit board 5 extends approximately circularly over approximately all of the clock body 2 except for an arcuate cutout 5*a* corresponding to the antenna structure 3 and a cutout or an opening 5*b* corresponding to a motor 6 and the like. On the board 5, for example, a wave reception IC (integrated circuit) (not shown) is mounted in addition to a main IC (not shown) concerning clock functions.

A battery 7 is disposed at a side opposite in a diameter direction to a region where the antenna structure 3 exist in the clock body 2, and a contact 8*a* to be contacted to a cathode of the battery 7 is provided, and a battery plus terminal 8 for providing reference potential to various circuit components at respective contacts 8*b* extends over a large area of the clock body 2. The clock components are set or fixed directly or indirectly on a base plate 80 as a base of the clock body 2. A component that is seen in the center is a train receiver 9.

Figure 2A:
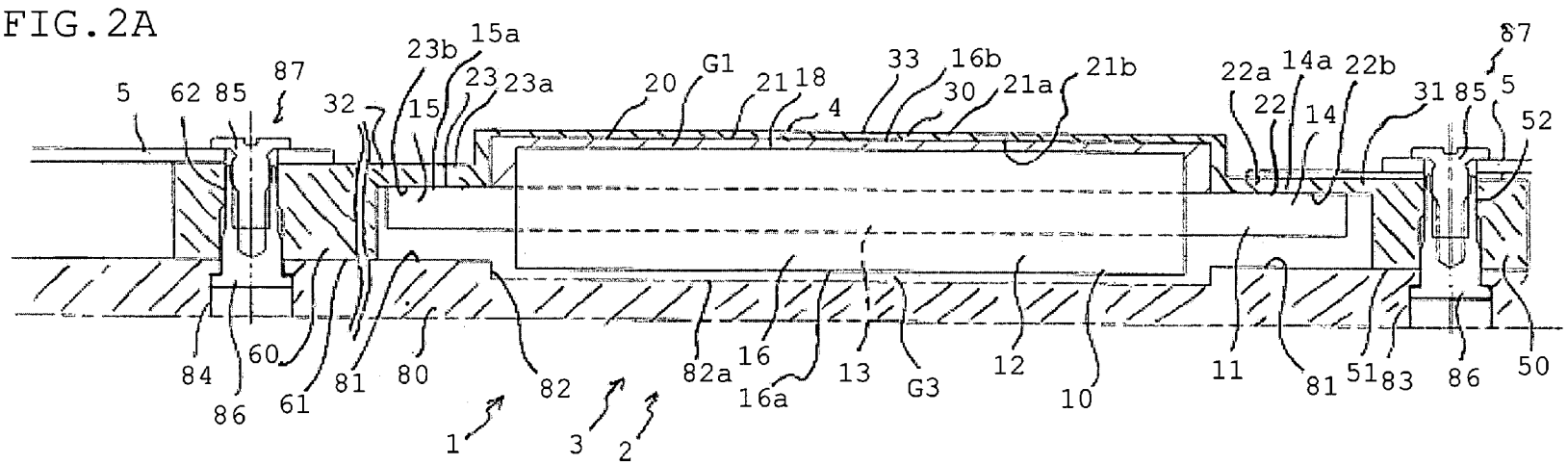
FIG. 2A is a longitudinal section, explanatory drawing of the antenna structure (however, a tuning circuit and mounting parts corresponding to the circuit are omitted)

As shown in FIG. 2A, the base plate 80 has a flat surface 81 on a region where the antenna structure 3 is set, and a shallow reception recess for winding part 82 is formed on the surface 81. The base plate 80 further has antenna mounting holes 83, 84.

As known from FIG. 2 to FIG. 6, the antenna body 10 comprises a magnetic core 11 made of ferrite such as a sintered body of Mn—Zn base ferrite powder and a winding wire (antenna wire) 12. As known from FIG. 6A and the like, the magnetic core 11 has an arcuately curved, core body 13 on which the winding wire 12 is wound, and large-diameter ends 14, 15 for mounting and positioning which are formed at two ends of the core body 13. The core body 13 has, for example, a square section as shown in FIG. 5B. On the other hand, the large-diameter ends 14, 15 have a rectangular section. Here, large diameter means large (wide) section size compared with the body, and any shape can be used as long as it is suitable for positioning and fixing. That is, a section profile or a planar pattern of the magnetic core 11 may be different from that of the represented example. As long as a winding area of the winding wire can be fixed, and sufficient strength for positioning is ensured, the core may be thinner than the body 13. A portion where the winding wire 12 is wound on the core body 13 is referred to as winding part 16 below.

Figure 3:
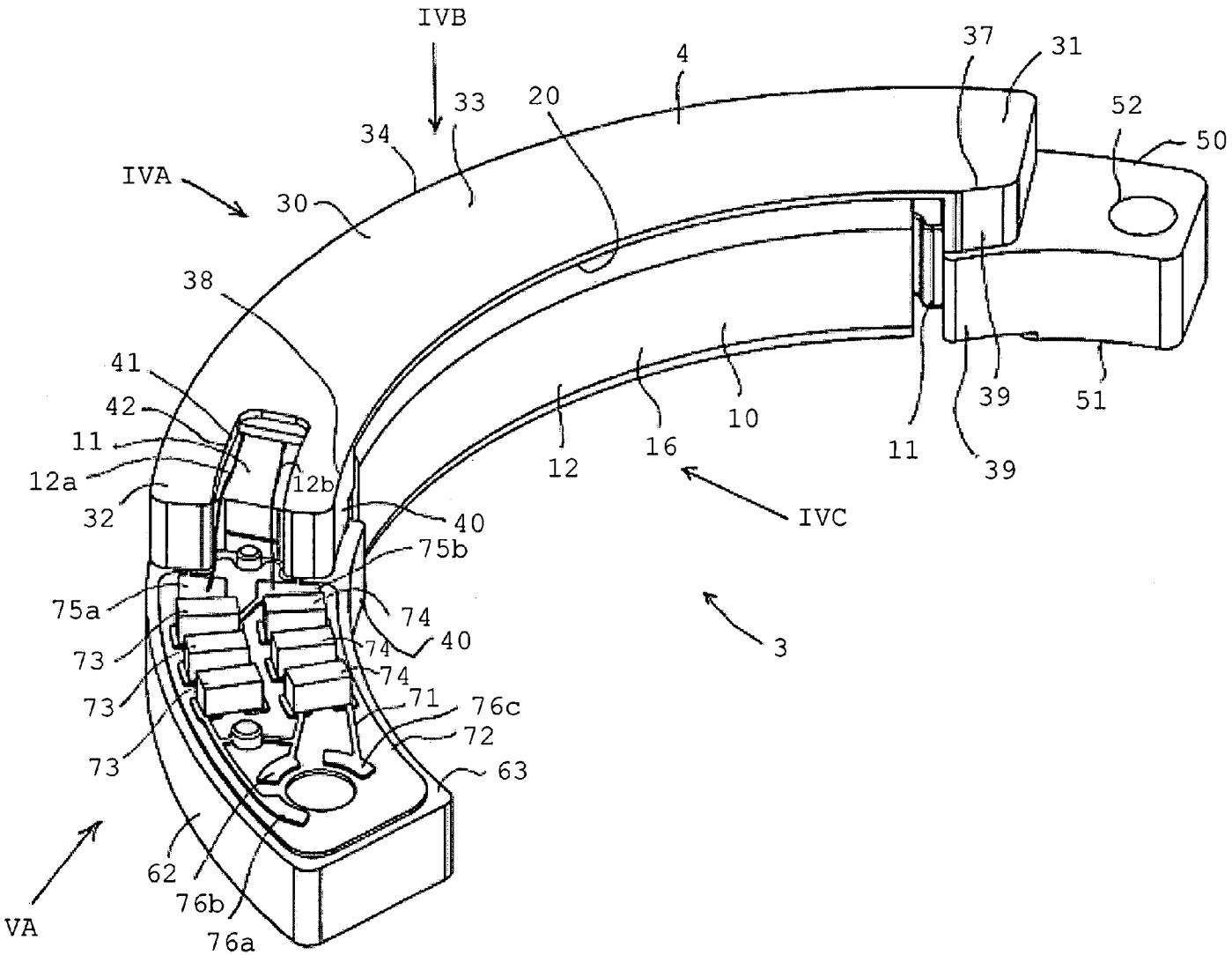
FIG. 3 is a perspective, explanatory drawing of the antenna structure of FIG. 1.
Figure 4C:
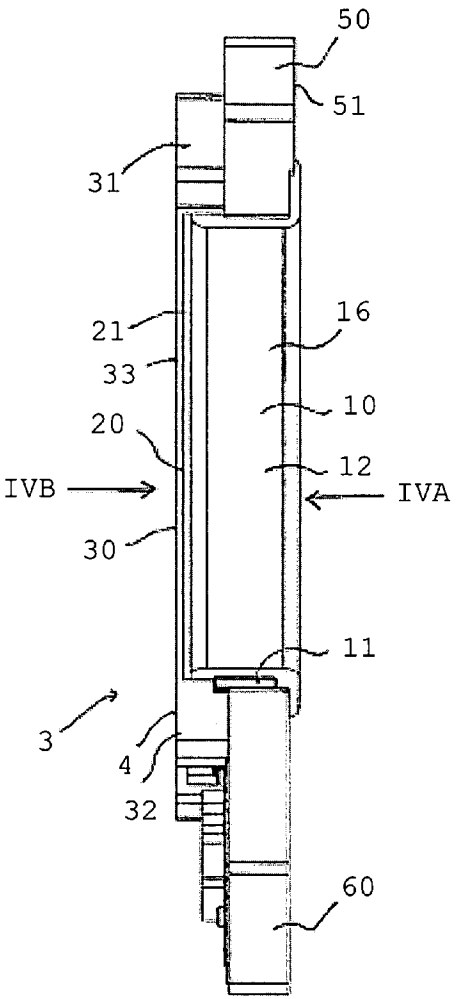
FIG. 4C is a side, explanatory drawing of the antenna structure of FIG. 3 and FIG. 4B, which is seen in a direction of an arrow IVC.
Figure 4B:
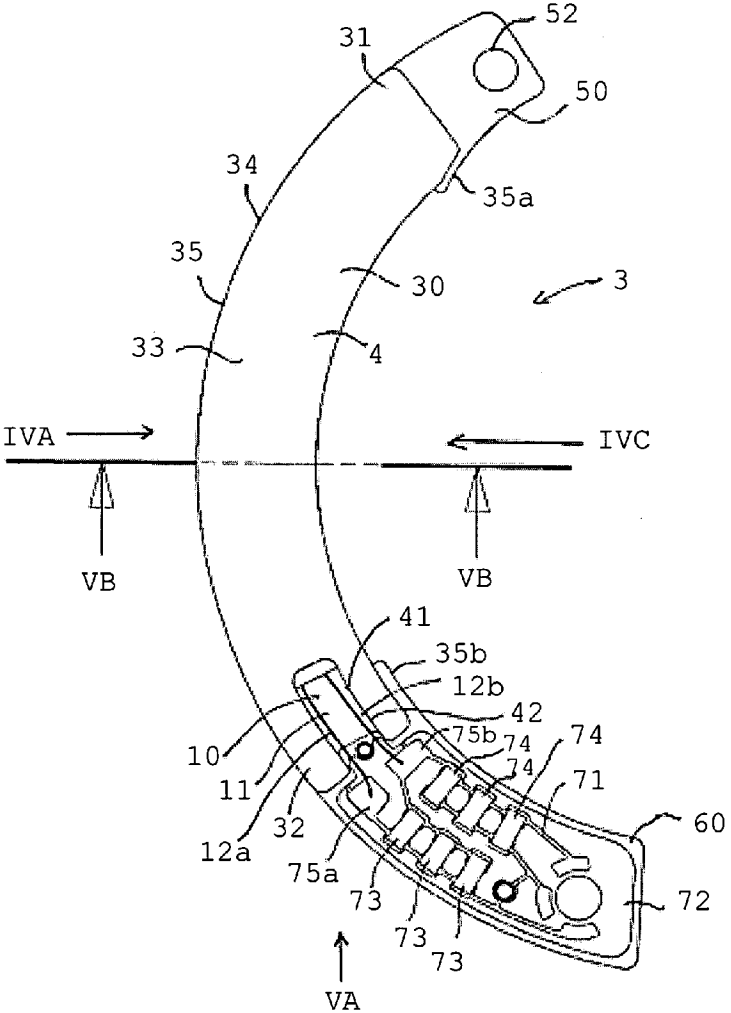
FIG. 4B is a plane, explanatory drawing of the antenna structure of FIG. 3 and FIG. 4A, which is seen in a direction of an arrow IVB.
Figure 6B:
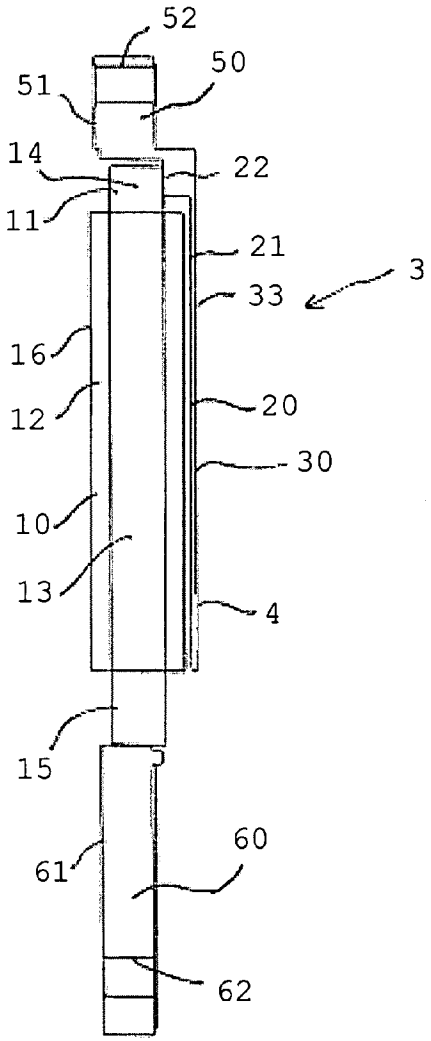
FIG. 6B is an end, explanatory drawing along a line VIB-VIB of the antenna structure of FIG. 6A.

As known from FIG. 3, FIG. 6 and FIG. 4C, the antenna frame 4 has an arcuate, antenna frame body 30 having an antenna receiving recess 20 for receiving an antenna body 10, and support legs 50, 60 integrally formed with two ends 31, 32 of the body 30.

Figure 5A:
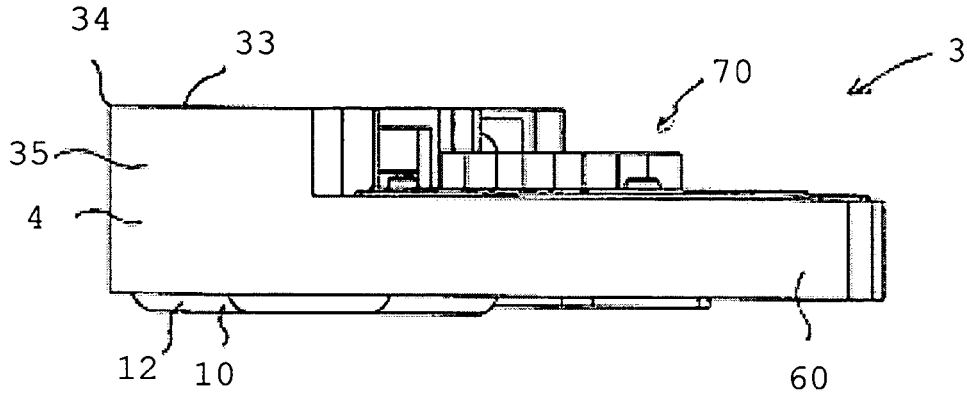
FIG. 5A is a side, explanatory drawing of the antenna structure of FIG. 3 and FIG. 4B, which is seen in a direction of an arrow VA.
Figure 5B:
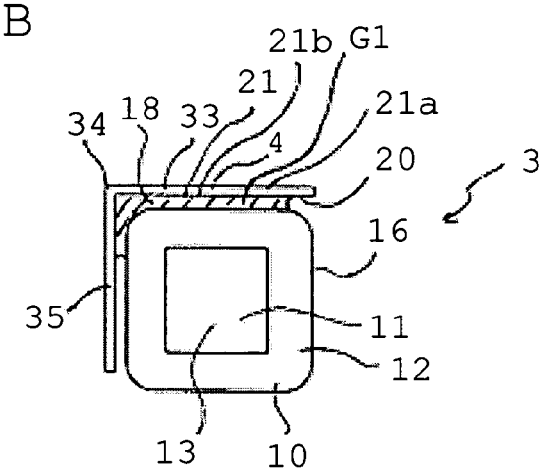
FIG. 5B is a section, explanatory drawing along a line VB-VB of FIG. 4A.
Figure 6A:
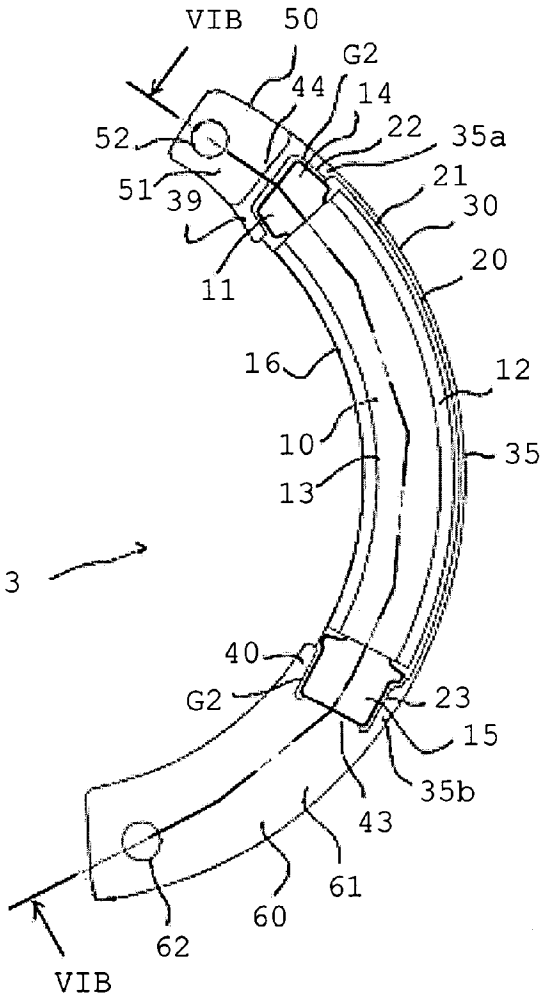
FIG. 6A is a bottom, explanatory drawing of the antenna structure of FIG. 4C, which is seen in a direction of an arrow VIA.

As known from FIG. 3 and FIG. 5, the antenna frame body 30 has a top wall 33 that forms a bottom wall of the recess 20 and extends arcuately, and an arcuately curved, outer circumferential wall 35 that is integrally connected to the top wall at an outer circumferential edge 34 of the circular arc of the top wall 33 and curved arcuately, and furthermore as known from FIG. 3 and FIG. 6A, it has inner circumferential walls 39, 40, that are integrally connected to the top walls at two ends 37, 38 of an inner circumferential edge 36 of the top wall 33. At the center in a lateral direction of one end 32 of the antenna frame body 30, as known from FIG. 3 and FIG. 4B, a cutout 41 for taking out ends 12*a*, 12*b* of the winding wire 12 is formed.

As known from FIGS. 6A and B and FIG. 2A, the antenna receiving recess 20 has an arcuate, receiving recess portion for winding part 21 for receiving a coil with magnetic core or winding part 16 on which the winding wire 12 of the antenna body 10 is wound, and receiving recess portions for magnetic-core ends 22, 23 for receiving the large-diameter core ends 14, 15 projected from two ends of the winding wire 12 of the antenna body 10. The receiving recess portions for magnetic-core ends 22, 23 are continuously connected to the receiving recess portion for winding part 21 at two ends of the receiving recess portion for winding part 21. As known from FIG. 2A, the receiving recess portion for winding part 21 and the receiving recess portions for magnetic-core ends 22, 23 are formed in such a depth (size) that when the ends 14, 15 of the magnetic core 11 of the antenna body 10 is contacted to bottoms 22*b*, 23*b* (surfaces of bottom walls 22*a*, 23*a* of the recess portions 22, 23 forming part of the top wall 33) of the receiving recess portions for magnetic-core ends 22, 23 at tops 14*a*, 15*a*, a gap G1 is remained between the outer circumference 16*b* of the winding part 16 and a bottom 21*b* (surface of a bottom wall 21*a* of the recess 21 forming part of the top wall 33) of the receiving recess portion 21 for winding part. A soft, silicone base adhesive 18 is filled into the gap G1, adhering the winding portion 16 to the bottom wall 21*a* of the recess portion 21.

As known from a cross section view of FIG. 5B, the receiving recess portion 21 for winding part is defined by the wall 21*a* forming part of the top wall 33 of the frame body 30 and the outer circumferential wall 35. On the other hand, the receiving recesses portions for magnetic-core ends 22, 23 are defined by the walls 22*a* and 23*a* forming part of the top wall 33, in addition, thick portions 35*a* and 35*b* of the outer circumferential wall 35, the inner circumferential walls 39 and 40, and end walls 43 and 44 (FIG. 6A), respectively. Referring to a bottom view of FIG. 6A, the end 14 of the magnetic core 11 is approximately perfectly fitted into a space between the walls 35*a* and 39 of the recess portion 22, and the end 15 is approximately perfectly fitted into a space between the walls 35*b* and 40 of the recess portion 23. Similarly, the magnetic core 11 is approximately perfectly fitted into a space between the end walls 43 and 44. In either case, exactly, there is a slight gap G2 as known from the figure, and the soft, silicone base adhesive is filled in the gap G2. The gap G2 is, for example, about 0.05 to 0.2 mm in size. In portions where the inner circumferential walls 39, 40 of the receiving recess portions for magnetic-core ends 22, 23 are provided, the antenna frame body 30 is increased in width at a side near the base plate 80.

As known from FIG. 3, one support leg 50 of the antenna frame 4 is formed integrally with the end 31 in a side near the base plate 80 of the end 31 of the antenna frame body 30. As known from FIG. 6 and FIG. 2A, the support leg 50 has a bottom 51 defining a contact surface and a mounting screw hole 52. Since a portion of the support leg 50 at a side of the antenna frame body 30 is continuously connected to a portion of the body 30 at a side of the support leg 50, a portion to which the connection portion belongs need not be specified. That is, the end of the receiving recess portion 20 for magnetic-core end 22 may be regarded to be within a range of the antenna frame body 30, or may be regarded that it partially enters the support leg 50 and is formed continuously therewith. This is similar in the following support leg 60.

As known from FIG. 3, the other support leg 60 of the antenna frame 4 is also formed integrally with the end 32 at a side near the base plate 80 of the end 32 of the antenna frame body 30. As known from FIG. 6 and FIG. 2A, the support leg 60 also has a bottom 61 at a surface level equal to that of the bottom 51 of the support leg 50 in order to define a contact surface, and a mounting screw hole 62.

In the above, the recess 20 is opened at least at a side where the surfaces 51, 61 situated at abase 80 side are provided. In this example, while there is no wall at the inner circumferential side of the antenna frame 4 because the antenna frame 4 is close to the circuit board 5 configuring the circuit block at the inner circumferential side and covered with the board 5, if there is a setting space, the antenna frame 4 may have a wall similarly at the inner circumferential side.

In FIG. 2A, for simplification of representation, portions concerning, setting of the circuit for tuning 70 that is described subsequently are omitted to be shown. The support leg 60 has a thickness about half the thickness of the antenna frame body 30, and as known from FIG. 3 and FIG. 4B, the top 63 of the support leg 60 faces the opening 42 formed by the cutout 41 at a side of the end 32 of the antenna frame body 30.

Figure 4A:
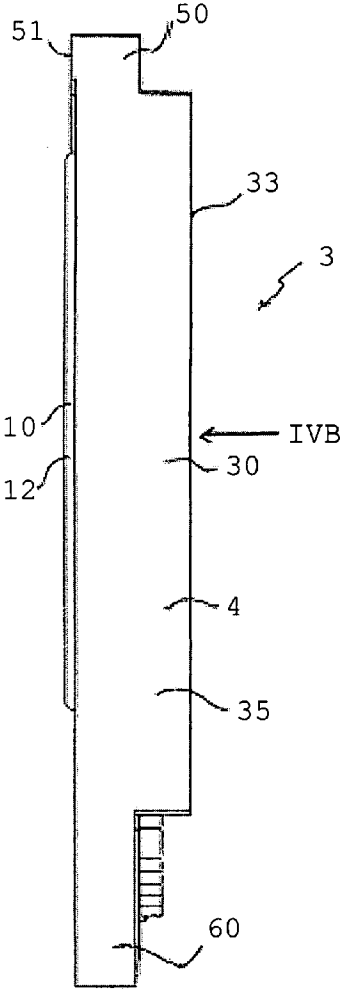
FIG. 4A is a side, explanatory drawing of the antenna structure of FIG. 3 and FIG. 4B, which is seen in a direction of an arrow IVA.

As known from FIG. 3 and FIG. 4, the circuit for tuning 70 is disposed on the top 63 of the support leg 60. The circuit for tuning 70 has a wiring board 72 on which a wiring pattern 71 is formed and plural groups of condensers 73, 74 mounted on the board 72. The wiring pattern 71 includes connection terminals 75*a*, 75*b* to which the ends 12*a*, 12*b* of the winding wire 12 are connected, and reception signal output side terminals 76*a*, 76*b* and 76*c* for extracting tuning or resonance output. The circuit for tuning 70 configures a tuning circuit (resonance circuit) for tuning to the standard wave including time information in cooperation with the coils with magnetic core 11, 12 configuring the antenna body 10, and outputs the received standard wave signal from a related terminal of the output side terminals 76*a*, 76*b* and 76*c*.

In assembly of the antenna structure 3 configured as above, the antenna body 10 is mounted in the recess 20 such that the winding portion 16 is received in the receiving recess portion for winding part 21 and the large-diameter ends 14, 15 of the magnetic core 11 are received in the receiving recess portions for magnetic core ends 22, 23. At that time, for example, the antenna frame 4 is first disposed such that the wall 33 is situated at the lower side and the surfaces 51, 61 face upward. Then, the antenna body 10 is set in the recess 20 of the antenna frame 4 such that the ends 14, 15 of the magnetic core 11 are contacted to bottoms 22*b*, 23*b* of the receiving recess portions for magnetic core ends 22, 23 of the recess 20 of the antenna frame 4 at the surfaces 14*a*, 15*a*. Then, the silicone base adhesive 18 is filled in the gap G1 between the outer circumference 16*b* of the winding part 16 of the antenna body 10 and the bottom 21*b* of the receiving recess portion for winding part 21 of the recess 20 of the antenna frame 4 to adhere and fix the antenna body 10 to the receiving recess portion for winding part 21 at the winding part 16. The adhesive can be filled from the inner circumference side at which the wall is not present of the antenna frame 4. It is acceptable that the adhesive 18 has been previously applied in the recess 21, and then the antenna body 10 is set at a predetermined place in the recess 20 and adhered thereto.

Moreover, in the above, a silicone base adhesive which has been applied in regions to form the gaps G2 between the large-diameter ends 14, 15 of the magnetic core 11 and the circumferential walls 35*a*, 39, 44 or 35*b*, 40, 43 of the recess portions 22 or 23, and the ends 14, 15 are fixed to the frame 4 using the adhesive (FIG. 6A). However, the adhesive in the gap G2 can be omitted.

As above, the large-diameter ends 14, 15 of the magnetic core 11 are accurately positioned and fixed with respect to the antenna frame 4 in an extending surface of the magnetic core 11 (surface parallel to an extending surface of the base plate 80), consequently the magnetic core 11 as a whole can be accurately positioned and fixed with respect to the antenna frame 4 in the extending surface of the magnetic core 11.

Next, the antenna structure 3 comprising the antenna frame 4 and the antenna body 10 that is positioned and fixed to a predetermined position in the recess 20 of the antenna frame 4 is disposed at a predetermined position in the base plate 80, and fixed to the base plate 80 by fastening means 87 comprising a male screw 85 and a female screw 86.

In fixing of the antenna structure 3, as shown in FIG. 2A, the antenna structure 3 is set on the base plate 80, and the fastening means 87 are inserted into respective holes 52, 83 and 62, 84 and screwed thereto such that bottoms 51, 61 of the support legs 50, 60 of the antenna frame 4 are contacted to the surface 81 of the base plate 80, and the holes 52, 62 of the support legs 50, 60 are aligned with the antenna mounting holes 83, 84 of the base plate 80. At that time, a gap G3 is remained between the surface 16*a* of the winding portion 16 of the antenna body 10 and the bottom 82*a* of the recess 82 of the base plate 80.

Therefore, the antenna body 10 of the antenna structure 3 can be accurately positioned in a direction perpendicular to the surface 81 of the base plate 80 via the antenna frame 4 that is contacted to the surface 81 of the base plate 80 at bottoms 51, 61, and contacts to the tops 14*a*, 15*a* of the large-diameter ends 14, 15 of the magnetic core 11 at the top wall surfaces 22*b*, 23*b* of the recess portions 22, 23. Since the two ends 14 and 15 of the magnetic core 11 is positioned in a horizontal plane (extending direction of the surface 81 of the base plate 80) by the circumferential walls 35*a*, 39, 44 and 35*b*, 40, 43 of the recesses 22 and 23 of the antenna frame 4, the antenna body 10 of the antenna structure 3 can be accurately positioned similarly in the horizontal plane with respect to the base plate 80 through positioning of the antenna frame 4 with respect to the base plate 80 by fastening means 87, 87.

As above, the antenna body 10 including the magnetic core 11 that has been positioned can be accurately fixed to the predetermined position with respect to the clock body 2. Therefore, even if a case, a back cover and the like, which are not shown, comprise metal, there is no possibility that the reception sensibility or reception characteristic of the antenna body 10 is excessively damaged by the case, back cover and the like, consequently variation in the reception sensitivity or reception characteristic of the antenna body 10 among individuals can be suppressed to a minimum.

In fixing of the antenna body 10, since the magnetic core 11 is positioned only with respect to the resin antenna frame 4, the magnetic core 11 may not experience locally large stress, consequently the magnetic core 11 is possibly not be broken.

Moreover, in the antenna structure 3, since the antenna body 10 is covered with the top wall 33 including the walls 21*a*, 22*a* and 23*a* at the back cover (not shown) side, even in a condition of the back cover being removed, it is lowly possible that tools and the like are directly touched on the antenna body 10 and thus give locally large shock to the antenna body 10, resulting in breakage of the magnetic core 11 or damage in the winding wire 12 of the winding part 16.

In addition, in the antenna structure 3, since the antenna body 10 is covered with the outer circumferential wall 35 at the outer circumferential side, even in the condition of the back cover being removed, it is lowly possible that tools and the like are touched on the antenna body 10 and thus give locally large shock to the antenna body 10, resulting in breakage of the magnetic core 11 of the antenna body 10 or damage in the winding wire 12.

In order to further reduce the shock given to the magnetic core 11 of the antenna body 10 even if goods such as tools are dropped on the antenna structure 3 by mistake in the condition of the back cover being removed, a plurality of projections may be formed on the surface of the antenna frame 4.

Figure 2B:
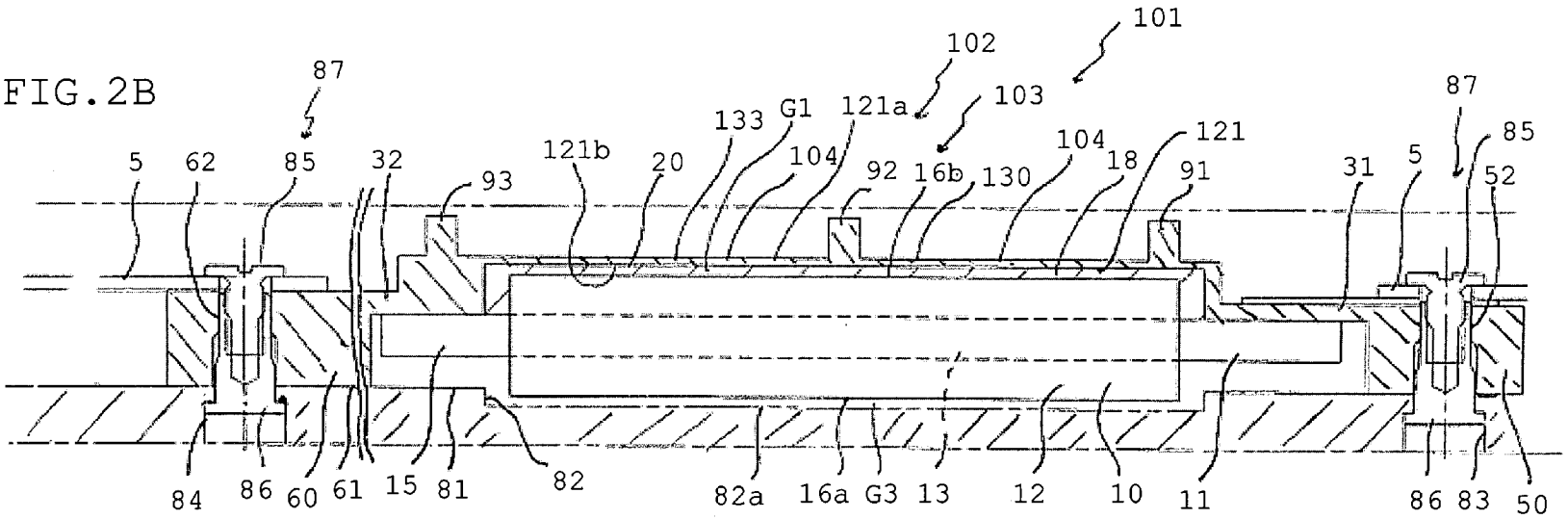
FIG. 2B is a longitudinal section, explanatory drawing of a modification of the antenna structure of FIG. 2A, which is similar to FIG. 2A.

For example, in an antenna structure 103 as shown in FIG. 2B, a plurality of projections 91, 92 and 93 are formed on a surface of a top wall 133 of a body 130 of an antenna frame 104. In a modification shown in FIG. 2B, elements identical to the elements of the example shown in FIG. 2A are marked with identical signs, and elements that are corresponding to but partially different from the elements in FIG. 2A are marked with signs expressed by adding 1 to hundred's digit of the signs in FIG. 2A.

In the case of the antenna structure 103 of FIG. 2B, even if tools and the like are dropped on the antenna body 104 of the antenna structure 103 by mistake in the condition of the back cover being removed, since the tools are touched on the projections 91, 92 and 93, dropping impact is not directly given to the top wall 133, and shock relieved by the projections 91, 92 and 93 is given to the antenna body 10 via the top wall 133, therefore possibility of breakage of the magnetic core 11 of the antenna body 10 can be further reduced. Furthermore, the projection group 91, 92 and 93 improves stiffness of the antenna frame 104 to be hardly transformed, thereby possibility of large stress exerted on the antenna body 10 can be reduced.

While description has been made assuming that the magnetic core 11 comprises the sintered body of Mn—Zn base ferrite powder in the above, other materials such as Ni—Zn base can be used instead of the Mn—Zn base as the material of ferrite, and other configuration such as a body bound by resin can be used for the ferrite instead of the sintered body. Moreover, materials of the magnetic core 11 may comprise other material instead of ferrite, and if desired, it may comprise a metal material such as an amorphous alloy (for example, laminated body of foils).

An insulating coating such as fluorine coating, a thin insulating sheet or the like can be interposed between the magnetic core 11 and the winding wire 12 as desired.

What is claimed is:

1. An antenna frame comprising:

a nonconductive material for receiving and fixing an antenna having an elongated and rod-like, magnetic core and a winding wire wound on the center in a longitudinal direction of the core;

a recess including a receiving recess portion for winding part for receiving a winding portion of the antenna and receiving recess portions for magnetic-core ends for receiving two ends of the magnetic core at both sides of the receiving recess portion for winding part, and having end mountings to be mounted on a base at the two ends, wherein when the antenna is received in the recess, the ends of the magnetic core of the antenna are positioned with respect to the receiving recess portions for magnetic-core ends, and wherein the end mountings are mounted on the base in a manner of being contacted to a mounting surface of the base at base side surfaces having openings of the recess.

2. An antenna structure comprising:

an antenna having an elongated and rod-like, magnetic core and a winding wire wound on the center in a longitudinal direction of the core and an antenna frame comprising a nonconductive material, wherein the antenna frame has a recess including a receiving recess portion for winding part for receiving a winding portion of the antenna and receiving recess portions for magnetic-core ends for receiving two ends of the magnetic core at both sides of the receiving recess portion for winding part, and has end mountings to be mounted on a base at the two ends, and the antenna frame is configured such that when the antenna is received in the recess, the ends of the magnetic core of the antenna are positioned with respect to the receiving recess portions for magnetic-core ends, and the antenna frame is configured such that the end mountings are mounted on the base in a manner of being contacted to a mounting surface of the base at base side surfaces having openings of the recess.

3. An antenna structure according to claim 2, wherein the magnetic core is curved arcuately, and the antenna frame has an outer circumferential wall for covering an outer circumference side of the magnetic core.

4. An antenna structure according to claim 2, wherein the antenna frame has a projection on a wall situated at a side opposite to the base side surface.

5. A watch type wave clock having the antenna structure according to claim 2.

* * * * *